US006655794B2

(12) United States Patent
Natterer et al.

(10) Patent No.: US 6,655,794 B2
(45) Date of Patent: Dec. 2, 2003

(54) METHODS AND APPARATUS FOR CURING A THERMAL SEALING MATERIAL USING A HEATER TRACE

(75) Inventors: Mark R. Natterer, Lebanon, OR (US); Jeffrey D. Langford, Lebanon, OR (US); Leo Clarke, Jr., Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/062,259

(22) Filed: Jan. 31, 2002

(65) Prior Publication Data

US 2003/0142182 A1 Jul. 31, 2003

(51) Int. Cl.[7] ..... B41J 2/14

(52) U.S. Cl. ..... 347/87; 347/58; 347/50

(58) Field of Search ..... 347/20, 50, 58, 347/87; 29/831

(56) References Cited

U.S. PATENT DOCUMENTS 5,189,787 A * 3/1993 Reed et al. ..... 29/831
6,402,299 B1 * 6/2002 DeMeerleer et al. ..... 347/50
6,460,966 B1 * 10/2002 Hellekson et al. ..... 347/20

* cited by examiner

*Primary Examiner*—Anh T. N. Vo

(57) ABSTRACT

Methods and apparatus are provided for forming a seal between two or more components using a thermally cured sealing material. One exemplary method includes selectively applying an electrical signal to a heating trace on a first component, applying a sealing material between at least a portion of the first component and at least a portion of a second component, and at least partially thermally curing the sealing material using thermal energy generated by the application of the electrical signal to the heating trace.

23 Claims, 4 Drawing Sheets

METHODS AND APPARATUS FOR CURING A THERMAL SEALING MATERIAL USING A HEATER TRACE

FIELD OF THE INVENTION

The present invention relates generally to thermally cured sealing and/or adhesive materials, and more particularly to improved methods and apparatus for curing such materials with the aid of an electrically heated conductive element or heater trace.

BACKGROUND OF THE INVENTION

In the manufacture of various devices and components there is often a need to adhere one object to another object and/or seal a surface of one object to a surface of another object. Various adhesives, glues and other sealants are available that may be used for this purpose. One exemplary group of such "sealing materials" includes materials that are cured or otherwise activated, etc., using thermal energy (i.e., heat).

During the manufacture of certain ink jet print cartridges, for example, a flexible strip that includes various electrical contacts and electrical traces is adhered to a pen body using a cover layer adhesive. While the cover layer adhesive adequately holds the flexible strip and pen body together, there is an additional need to form a seal around all or part of the flexible strip to prevent certain liquids (such as corrosive ink) from coming in contact with the electrical traces/contacts. This seal, for example, can be formed using a thermally cured sealing material. Here, it should be understood that the sealing material can be a sealant, adhesive, or other type of material that can adequately provide a seal around all or part of the flexible strip.

In this print cartridge example, the sealing material is configured to prevent liquids such as inks, solvents, etc., associated with the operation and/or maintenance of the printing device and print cartridge, from seeping through and entering the cover layer adhesive region and electrically shorting or otherwise deleteriously affecting (e.g., corroding) the electrical traces/contacts provided on the flexible strip. As such, the sealing material needs to be selected such that it is substantially impermeable to such liquids and is able to withstand the operating parameters of the printing device/environment. The sealing material should also be selected such that it does not interfere with the operation of the print cartridge during printing operations. For example, in certain implementations, the sealing material may need to exhibit a significantly low physical profile to allow for the print cartridge to be operatively placed in close proximity to a print medium within the printing device. The selection of the sealing material may also be based on the needs of the manufacturing process. For example, to provide an efficient manufacturing process it may be beneficial to select a sealing material that can be quickly applied, cured and/or dried.

Based on these needs and/or others, thermally cured sealing materials appear to provide a satisfactory solution. Unfortunately, when conventional heating techniques such as, e.g., forced heated air, are employed to thermally cure the sealing material the resulting seal between the flexible strip and pen body may have small openings that allow inks and other liquids to penetrate though the seal. In certain instances, for example, it has been found that air that is trapped between the flexible strip and pen body during the application of the sealing material can expand during the subsequent thermal curing process and form bubbles or holes that breach the resulting seal.

Consequently, there is a need for improved methods and apparatus for thermally curing sealing materials.

SUMMARY OF THE INVENTION

Methods and apparatus are provided for forming a seal between two or more components using a thermally cured sealing material. One exemplary method includes selectively applying an electrical signal to a heating trace on a first component, applying a sealing material between at least a portion of the first component and at least a portion of a second component, and at least partially thermally curing the sealing material using thermal energy generated by the application of the electrical signal to the heating trace.

In certain implementations, the thermally cured sealing material is in physical contact with at least a portion of the electrical heater trace. The electrical heater trace may be positioned near an edge of the second component and configured to be substantially uniformly heated when the electrical signal is applied to it, or to be non-uniformly heated when the electrical signal is applied to it. In certain implementations, the first component may further include a channel corresponding to at least one edge of the second component and configured to receive the sealing material. In accordance with certain exemplary implementations of the present invention, the apparatus is a print cartridge, in which the first component includes a pen body and the second component includes a flexible strip.

In accordance with still other exemplary implementations of the present invention, a method is also provided for providing a seal between at least two components using a thermally cured sealing material. Here, for example, the method includes selectively applying an electrical signal to a heating element on a first component, applying a sealing material between at least a portion of the first component and at least a portion of a second component, and at least partially thermally curing the sealing material using thermal energy generated by the application of the electrical signal to the heating element. Here, the heating element may include a heater trace that is produces a substantially uniform amount of thermal energy along the heater trace or a non-uniform amount of thermal energy along the heater trace. The selective application of the electrical signal to the heating element may be done prior to applying the sealing material, while applying the sealing material, and/or after applying the sealing material. The sealing material may, for example, include a sealant, an adhesive, glue, or other like substance.

DESCRIPTION OF THE DRAWINGS

A more complete understanding of the various methods and apparatus of the present invention may be had by reference to the following detailed description when taken in conjunction with the accompanying drawings wherein.

DETAILED DESCRIPTION

While the following description focuses on improvements associated with the manufacture of print cartridges that are used with printing devices, it should be understood that the various methods and apparatus provided herein are clearly adaptable to other devices, components, etc. Indeed, as will be described with respect to FIG. 9, the methods and arrangements provided herein can be used to provide a seal between two or more surfaces of two or more objects/components using locally thermally cured "sealing materials".

Figure 1:
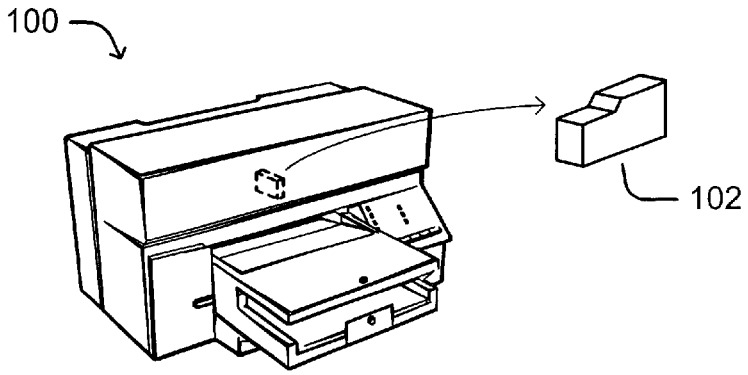
FIG. 1 is an illustrative diagram depicting a printing device having at least one removable/replaceable printing cartridge therein, in accordance with certain exemplary implementations of the present invention.

With this in mind, reference is now made to FIG. 1, which is an illustrative diagram depicting a printing device 100 having at least one removable/replaceable printing cartridge 102 therein, in accordance with certain exemplary implementations of the present invention. By way of example, printing device 100 may be an ink jet printer, a copier, a facsimile machine, or the like. As with conventional print cartridges, print cartridge 102 would typically include a reservoir of one or more inks, ink jet nozzle(s) and the supportive electrical elements needed to selectively cause one or more ink drops to be ejected from print cartridge 102 onto a print media (not shown).

Figure 2:
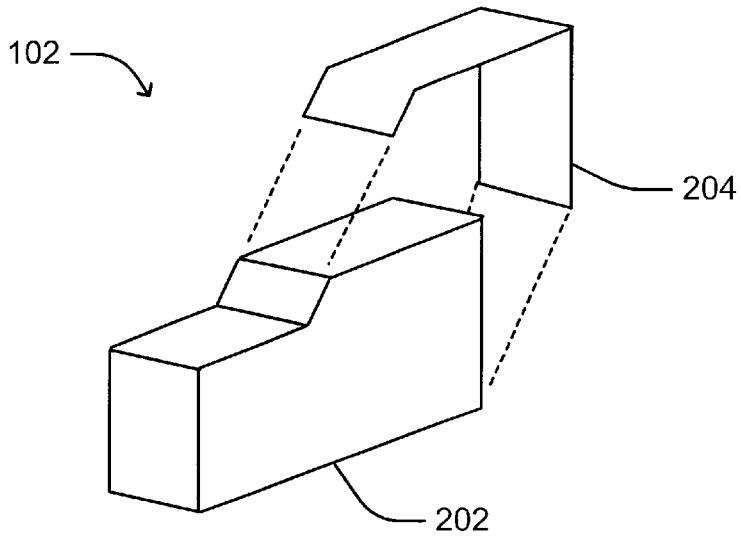
FIG. 2 is an illustrative diagram depicting a print cartridge, for example, as in FIG. 1, having a pen body and a flexible strip, in accordance with certain exemplary implementations of the present invention.

FIG. 2 is an illustrative diagram further depicting two portions or components of print cartridge 102, for example, as in FIG. 1. Here, print cartridge 102 includes a pen body 202 and a flexible strip 204, in accordance with certain exemplary implementations of the present invention. As illustrated by the dashed lines, flexible strip 204 is configured to flexibly conform to corresponding surfaces of pen body 202 when fixedly applied or attached thereto. Flexible strip 204, in this example, includes various electrical traces and contacts that are arranged to support the printing operation. For example, electrically conducting contacts and traces can be provided that allow the printing device to selectively control the formation and outputting of ink drops or droplets by print cartridge 102. Pen body 202, in this example, would include at least one reservoir (e.g., a regulated bag) of liquid ink (not shown).

As described above in the Background section, there is a need to insure that certain inks, solvents, etc., do not come in contact with certain electrical contacts and/or traces provided by flexible strip 204. One way to accomplish this is to form a seal between flexible strip 204 and pen body 202. With regard to the exemplary implementation of print cartridge 204, this seal is preferably formed near the edge of flexible strip 204, and may extend around all or part of flexible strip 204.

In this example, the seal is formed using a thermally cured "sealing material". As mentioned above, it has been discovered that conventional heating techniques tend to cause small breaches in the seal due to expanding gases. These small openings may allow unwanted liquids to pass through the seal and come in contact with the electrical traces, etc, provided by flexible strip 204. To reduce the potential for such openings in the seal, at least one heating trace may be added to flexible strip 204 and operatively/selectively configured to locally heat up certain areas of flexible strip 204 and nearby gases (e.g., air). The heating trace of the exemplary embodiment is formed simultaneously with and in the same manner and of the same materials as the various other electrical traces on flexible strip 204, using processes known in the art.

Thus, for example, in accordance with certain implementations of the present invention, by selectively passing an electrical current through a heater trace on flexible strip 204 prior to and/or at about the same time as the sealing material is applied to flexible strip 204 and pen body 202, the resulting thermal energy will expand the nearby gases in such a manner as to significantly reduce or eliminate the formation of unwanted vent holes, etc., in the resulting seal. Furthermore, the heater trace can be used to thermally cure the sealing material in such a manner that other portions of flexible strip 204 and/or pen body 202 are not significantly heated up. For example, unlike conventional forced air heating techniques, the more localized heat provided by the heater trace will reduce the possibility of heating up an internal ink-holding bag within pen body 202. The trace may also be selectively energized to heat the sealing material to one temperature during the initial part of the curing process, during which time bubbles are prone to develop; and then, after the sealing material has cured sufficiently that it is relatively firm and bubble formation is inhibited, to a higher temperature to complete the curing process.

Figure 3:
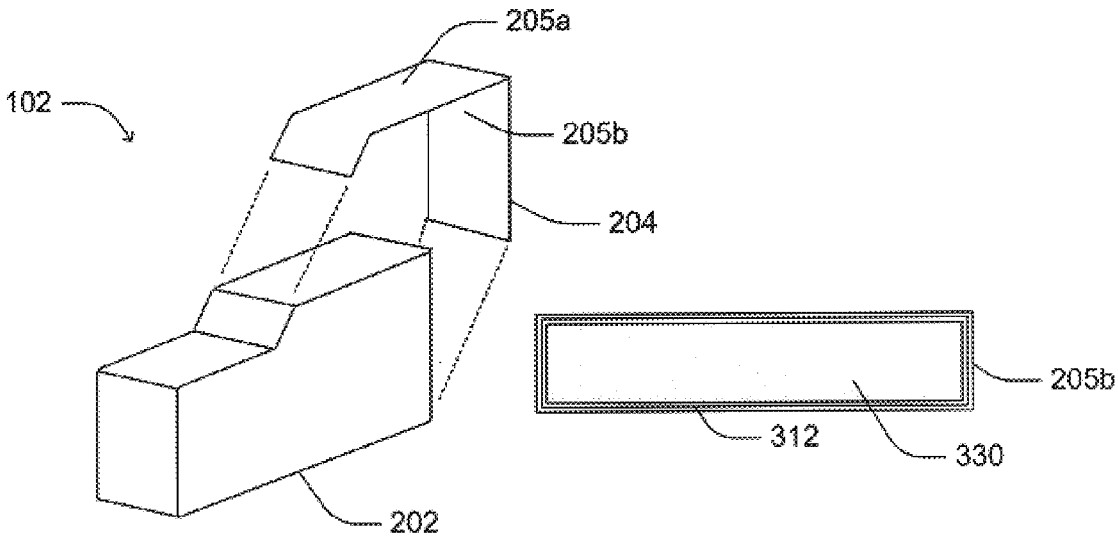
FIG. 3 is a further illustrative diagram depicting a print cartridge, for example, as in FIG. 2, wherein the flexible strip includes a heater trace, in accordance with certain exemplary implementations of the present invention.

With these improvements in mind, attention is drawn to FIG. 3, which further illustratively depicts flexible strip 204 as having a heater trace 312 thereon, in accordance with certain exemplary implementations of the present invention. Here, flexible strip 204 includes an exposed side 205*a* and a trace side 205*b*. A cover layer (adhesive) 330 is provided on trace side 205*b* along with heater trace 312. In this exemplary implementation, heater trace 312 extends around trace side 205*b* and is not itself covered by cover layer 330. In other implementations, heater trace 312 may extend around only a portion of trace side 204, and/or may be at least partially in contact with cover layer 330. In still other implementations, heater trace 312 may be provided on exposed side 205*a*, and/or be configured internally within flexible strip 204.

Although depicted as a fairly uniformly sized trace in FIG. 3, it should be understood that heater trace 312 may vary in width and/or thickness such that certain portions of heater trace 312 produce more heat than others. Moreover, heater trace 312 may be more than a conductive trace in that it may include electrically resistive materials and/or sections. For example, depending upon the shape/size of pen body 202/202' and/or flexible strip 204, there may be regions that need to reach a higher temperature to effectively reduce the formation of unwanted holes in sealing material 320, and/or adequately thermally cure sealing material 320.

Figure 4:
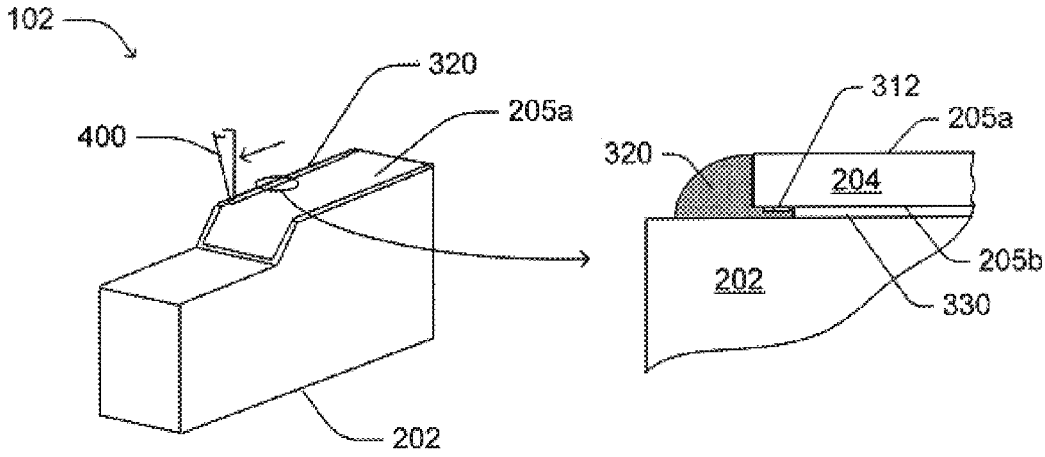
FIG. 4 is an illustrative diagram depicting the application and curing of sealing material between the pen body and a flexible strip, for example, as in FIG. 3, in accordance with certain exemplary implementations of the present invention.

FIG. 4 illustrates the application and curing of sealing material 320 between pen body 202 and flexible strip 204, for example, as in FIG. 3, in accordance with certain exemplary implementations of the present invention. Here, a sealant applicator 400 is configured to apply sealing material 320 to flexible strip 204 and pen body 202. As illustrated in the close-up, cross sectional view of the resulting sealing material interface, sealing material 320 has conformed to both flexible strip 204 and pen body 202. In this exemplary implementation, sealing material 320 has flowed into and substantially filled the opening around heater trace 312.

Figure 5:
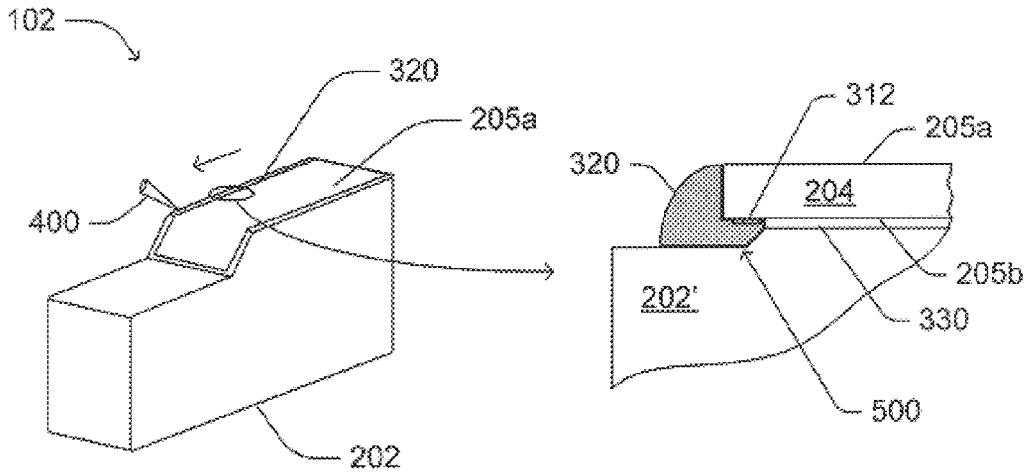
FIG. 5 is an illustrative diagram depicting the application and curing of sealing material between a pen body having a channel and a flexible strip, in accordance with certain further exemplary implementations of the present invention.

FIG. 5 is a similar illustrative diagram depicting the application and curing of sealing material 320 between a pen body 202' and flexible strip 204, in accordance with certain further exemplary implementations of the present invention. Here, pen body 202' further includes a channel 500 that extends around at least a portion of pen body 202 and is configured to allow sealing material 320 to more easily flow into, around, and/or underneath the edge of flexible strip 204. As illustrated, sealant applicator 400 can be positioned to an angle that allows for the sealing material to better flow into the region created by channel 500.

Channel 500 provides several advantages. For example, channel 500 may allow sealing material 320 to have a lower profile. A lower profile helps allows for closer pen to paper spacing, which can be an important design objective in many printing devices. Channel 500 significantly addresses such design objectives, while also improving pen ink resistance and pen life.

Channel 500 or other like grooves or machined areas in pen body 202' may increase the contact area of sealing material 320, which provides several advantages, depending upon the pen body design. For example, increases in the contact area can improve adhesion of flexible strip 204 to pen body 320 and if possible cover layer 300. This tends to further improve the ink resistance, which increases the operating life of the resulting pen. For example, channel 500 increases the path length that ink has to migrate through and around before it can harm the electrical traces, etc.

Channel 500 also allows sealing material 320 to be retained and or located in an improved manner. For example, as sealing material 320 is applied and heated by heater trace 312, the viscosity of sealing material 312 usually changes and may present a problem if sealing material 320 moves to other unintended parts of pen body 202/202'. However, channel 500 tends to keep sealing material 320 where it was intended to be.

Channel 500 or other like features can also be designed so that trapped gases can be managed or routed as heater trace 312 heats up. Thus, instead of allowing expanding gases to seek an escape route, e.g., possibly through sealing material 320, channel 500 can be designed to route the gases in a controlled fashion.

Channel 500 may further allow for more sealing material 320 to be applied. Basically, more bulk sealing material tends to make it harder for ink to migrate into the electrical traces, etc. In certain implementations, for example, the amount of sealing material 320 applied to pen body 202' is about double the amount applied to pen body 202. As a result of channel 500 the added amount of sealing material does not impinge on the pen to paper spacing and other mechanical envelope issues.

Channel 500 can also be useful in providing a strong perimeter attachment of flexible strip 204 to pen body 202'. In certain implementations, for example, portions of flexible strip 204 are mechanically wiped by a maintenance mechanism (not shown). Such wiping movement stresses and pushes on that portion of flexible strip 204, typically in a cyclical fashion. This action may lead to premature failure of cover layer 300. However, with the perimeter adhesive action of sealing material 320 the affected area of flexible strip 204 can remain anchored even if cover layer 300 fails. Those skilled in the art will recognize that in certain implementations, therefore, it may be possible to reduce the size of, or possible eliminate, cover layer 300.

Furthermore, the low profile of sealing material 320 as a result of channel 500 will not interfere with such pen wiping actions or wipers while still providing ink resistance.

Figure 6:
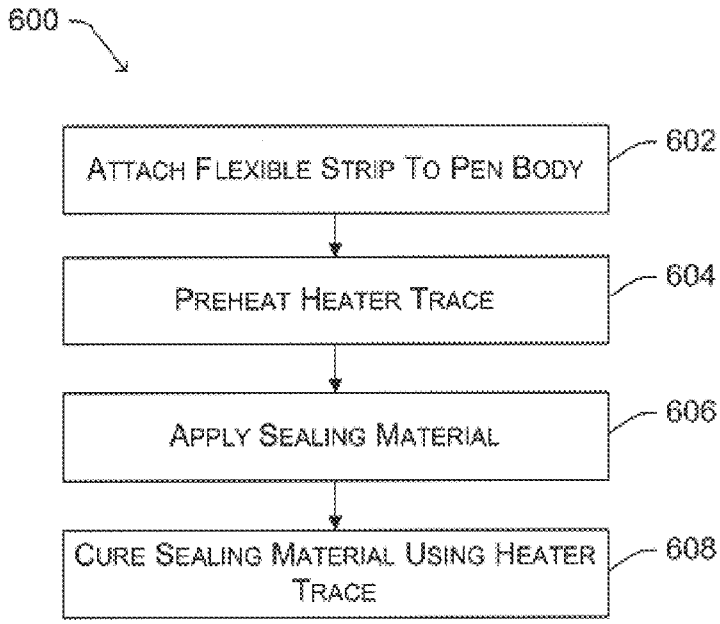
FIG. 6 is a flow diagram of a process for providing a seal between a pen body and a flexible strip, in accordance with certain exemplary implementations of the present invention.

FIG. 6 is a flow diagram of a process 600 for providing an improved seal between pen body 202/202' and flexible strip 204, in accordance with certain exemplary implementations of the present invention.

In step 602, flexible strip 204 is fixedly attached to pen body 202/202', for example, using a cover layer 330 or other like adhesive material. At the same time and/or thereafter, heater trace 312 is preheated by passing an electrical current through it. This generates heat in and around the region that sealing material 320 is to be applied. In step 606, following at least a portion of the preheating of step 604, sealing material 320 is applied in such a manner as to form a seal between flexible strip 204 and pen body 202/202'. Next, in step 608, sealing material 320 is thermally cured by continued application of electrical current to heater trace 312. In certain implementations, the electrical current applied to heater trace 312 remains at about the same level through steps 604–608. In other implementations, the amount of electrical current applied to heater trace 312 is selectively varied during steps 604–608. In this manner, the thermal energy output of heater trace 312 can be controlled to provide an optimal sealing material application and/or curing environment.

Figure 7:
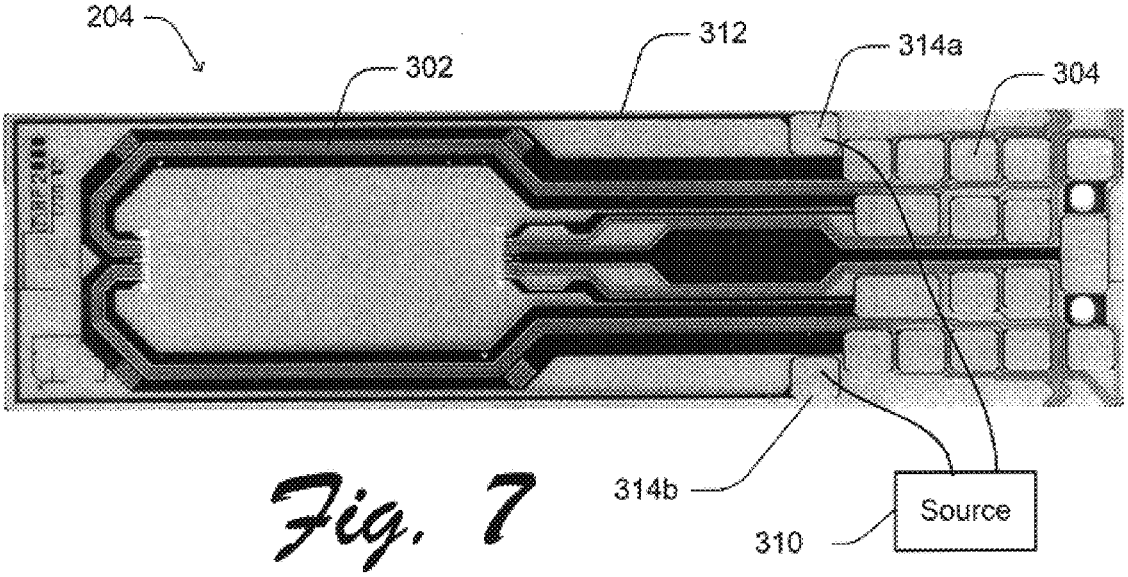
FIG. 7 illustrates an exemplary layout view of a flexible strip, in accordance with certain implementations of the present invention.

FIG. 7 illustrates a top view of an exemplary non-opaque flexible strip 204, in accordance with certain implementations of the present invention. As shown, a plurality of electrical circuit traces 302 and electrical contacts 304 are provided for operating a print cartridge. In this example, heater trace 312 extends about a portion of flexible strip 204, between heater trace contact pad 314*a* and heater trace contact pad 314*b*. When being preheated/heated, an electrical signal (e.g., a direct current (DC) signal) from a source 310 is applied through heater trace contact pads 314*a*–*b* and heater trace 312 there between.

Figure 8:
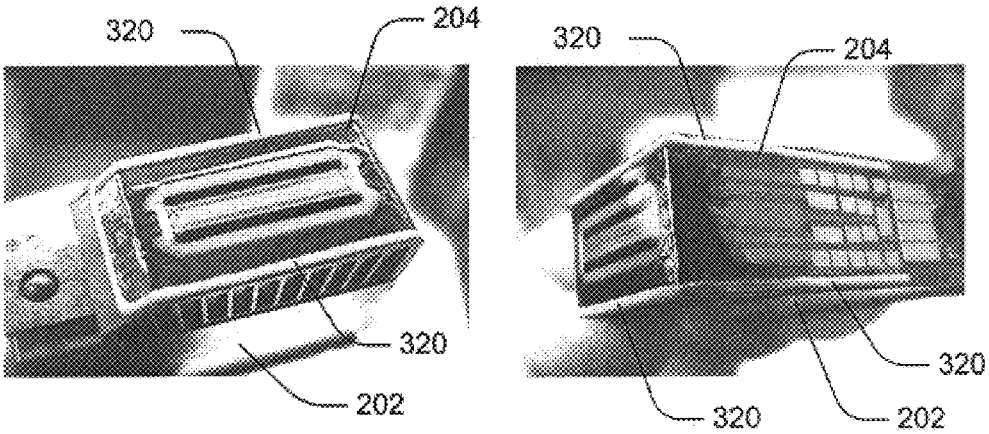
FIG. 8 illustrates two views of a print cartridge having a flexible strip fixedly attached to a pen body and having a portion of the flexible strip that is sealed to the pen body, in accordance with certain exemplary implementations of the present invention.

To further illustrate the exemplary implementations described above, FIG. 8 pictorially shows two views of print cartridge 102 having flexible strip 204 fixedly attached to pen body 202/202' and having a portion of flexible strip 204 that is sealed to a corresponding portion of pen body 202/202', in accordance with certain implementations of the present invention. Here, as shown, sealing material 320 has been applied to the portions of flexible strip 204 and pen body 202/202' associated with heater strip 312. The resulting thermally cured sealing material 320 provides a seal that is not permeable to the liquids typically involved in the printing process.

Figure 9:
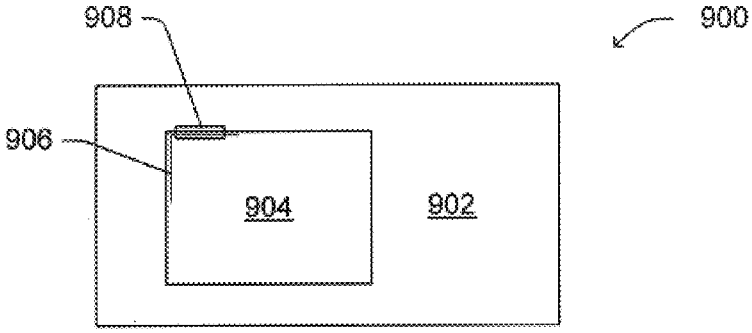
FIG. 9 is a block diagram illustratively depicting two component parts that include a thermally cured sealing material interface there between and at least one heater trace or like heating element, in accordance with certain further exemplary implementations of the present invention.

FIG. 9 is a block diagram illustratively depicting a device 900 having two component parts 902 and 904 that include a thermally cured sealing material interface 908 there between and at least one heater trace 906 or like heating element, in accordance with certain further exemplary implementations of the present invention. Component parts 902 and 904 are representative of any types of components, materials, surfaces, etc., which are to have a seal formed there between using a thermally cured sealing material. Heater trace 906 is configured to provide the thermal energy associated with the thermally cured sealing process when an electrical signal is passed through it. While heater trace 906 is depicted nearby the edge of component part 904, it should be understood that heater trace 906 may be placed in other regions of component part 904 and/or 902. Heater trace 906 may be part of component part 904 and/or component part 902. Additionally, one or more gas venting troughs or like features (not shown) can be provided in either component part 902 and/or component part 904 to provide a path for heated gases to escape from between the component parts without having to pass through the sealing material interface.

Thus, although some preferred implementations of the various methods and apparatus of the present invention have been illustrated in the accompanying Drawings and described in the foregoing Detailed Description, it will be understood that the invention is not limited to the exemplary implementations disclosed, but is capable of numerous rearrangements, modifications and substitutions without departing from the spirit of the invention as set forth and defined by the following claims.

What is claimed is:

1. An apparatus comprising:

a first component;

a second component having at least one electrical heater trace; and a thermally cured sealing material interface physically coupled between at least a portion of said first component and at least a portion of said second component, said at least a portion of said second component being controllably heatable by said electrical heater trace when an electrical signal is applied through said electrical heater trace, and wherein said first component includes at least one channel corresponding to at least one edge of said second component that is configured to receive said sealing material.

2. The apparatus as recited in claim 1, wherein said second component is fixedly attached to said first component.

3. The apparatus as recited in claim 1, wherein said thermally cured sealing material interface is in physical contact with at least a portion of said electrical heater trace.

4. The apparatus as recited in claim 1, wherein said electrical heater trace is positioned near an edge of said second component.

5. The apparatus as recited in claim 1, wherein said electrical heater trace is configured to be substantially uniformly heated when said electrical signal is applied thereto.

6. The apparatus as recited in claim 1, wherein said electrical heater trace is configured to be non-uniformly heated when said electrical signal is applied thereto.

7. The apparatus as recited in claim 1, wherein said thermally cured sealing material interface includes at least one sealing material selected from a group of thermally cured materials comprising a sealant, an adhesive, and a glue.

8. The apparatus as recited in claim 7, wherein said channel is configured to controllably route gases from between said first and second components.

9. The apparatus as recited in claim 1, wherein said first component includes a pen body and said second component includes a flexible strip.

10. The apparatus as recited in claim 9, wherein said flexible strip further comprises circuit traces for activating an inkjet printhead.

11. A method comprising:

selectively applying an electrical signal to a heater trace on a first component;

applying a sealing material between at least a portion of said first component and at least a portion of a second component; and at least partially thermally curing said sealing material using thermal energy generated by the application of said electrical signal to said heater trace, and wherein said first component includes at least one channel corresponding to at least one edge of said second component that is configured to receive said sealing material.

12. The method as recited in claim 11, wherein said heater trace produces a substantially uniform amount of thermal energy along said heater trace.

13. The method as recited in claim 11, wherein said heater trace produces a selective non-uniform amount of thermal energy along said heater trace.

14. The method as recited in claim 11, wherein selectively applying said electrical signal to said heater trace further includes:

selectively preheating said heater trace prior to applying said sealing material.

15. The method as recited in claim 11, wherein selectively applying said electrical signal to said heater trace further includes:

selectively heating said heater trace while applying said sealing material.

16. The method as recited in claim 11, wherein selectively applying said electrical signal to said heater trace further includes:

selectively heating said heater trace after applying said sealing material.

17. The method as recited in claim 11, wherein said sealing material includes at least one sealing material selected from a group of thermally cured materials comprising a sealant, an adhesive, and a glue.

18. The method as recited in claim 11, wherein said first component includes a flexible strip and said second component includes a pen body.

19. The method as recited in claim 11, wherein selectively applying said electrical signal to said heater trace further includes:

after applying said sealing material, selectively heating said heater trace to a first temperature during a curing time interval; and then selectively heating said heater trace to a second temperature during a second curing time interval.

20. A print cartridge for use with a printing device, the print cartridge comprising:

a pen body;

a flexible strip affixed to said pen body, said flexible strip including an electrical heater trace that extends about at least a portion of said flexible strip and is located near at least one edge of said flexible strip; and a thermally cured sealing material coupling at least a portion of said flexible strip to at least a portion of said pen body, said thermally cured sealing material forming a seal between said flexible strip and said pen body nearby the location of said electrical heater trace, and wherein said pen body includes at least one channel corresponding to at least one edge of said flexible strip this is configured to receive said sealing material.

21. The print cartridge as recited in claim 20, wherein said electrical heater trace is configured to produce a substantially uniform amount of thermal energy along said heater trace.

22. The print cartridge as recited in claim 20, wherein said electrical heater trace is configured to produce a non-uniform amount of thermal energy along said heater trace.

23. The print cartridge as recited in claim 20, wherein said channel is configured to controllably route gases from between said pen body and said flexible strip.

* * * * *